US009950196B2

(12) United States Patent
Koch

(10) Patent No.: US 9,950,196 B2
(45) Date of Patent: Apr. 24, 2018

(54) BREATHING CIRCUIT DEVICE

(75) Inventor: Jochim Koch, Ratzeburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1699 days.

(21) Appl. No.: 13/044,167

(22) Filed: Mar. 9, 2011

(65) Prior Publication Data

US 2011/0247618 A1 Oct. 13, 2011

(30) Foreign Application Priority Data

Apr. 8, 2010 (EP) ..... 10159309

(51) Int. Cl.
*A62B 7/00* (2006.01)
*A62B 9/00* (2006.01)
*B63C 11/24* (2006.01)

(52) U.S. Cl.
CPC ..... *A62B 7/00* (2013.01); *A62B 9/003* (2013.01); *B63C 11/24* (2013.01)

(58) Field of Classification Search
CPC ..... A62B 7/00; A62B 9/003; A61M 16/1075; A61M 16/22; A61M 2205/3368; B63C 11/24
USPC ..... 128/204.15, 204.18, 205.17, 205.25
See application file for complete search history.

(56) References Cited

U.S. PATENT DOCUMENTS

| | | | | |
|---|---|---|---|---|
| 3,527,214 A | | 9/1970 | Rio et al. | |
| 3,869,871 A | * | 3/1975 | Rybalko et al. | 62/178 |
| 4,188,947 A | * | 2/1980 | Pasternack | A62B 9/003 128/202.26 |
| 4,817,597 A | * | 4/1989 | Tanaka | A62B 7/08 128/205.17 |
| 5,269,293 A | * | 12/1993 | Loser | F25B 17/08 128/204.15 |
| 5,435,152 A | * | 7/1995 | McCausland | F04B 43/043 417/413.1 |
| 6,990,979 B2 | * | 1/2006 | Koch | A62B 7/08 128/204.13 |
| 2007/0157929 A1 | * | 7/2007 | Radomski et al. | 128/204.18 |
| 2010/0108063 A1 | * | 5/2010 | Koch | A61M 16/1075 128/204.15 |

FOREIGN PATENT DOCUMENTS

| | | |
|---|---|---|
| DE | 27 00 492 B1 | 5/1978 |
| DE | 40 29 084 A1 | 3/1992 |

* cited by examiner

*Primary Examiner* — Tan-Uyen (Jackie) T Ho
*Assistant Examiner* — Jonathan Paciorek
(74) *Attorney, Agent, or Firm* — McGlew and Tuttle, P.C.

(57) ABSTRACT

A breathing circuit device has a breathing gas line for forming a closed breathing system, with a cooling device with at least one cooling element for cooling a breathing gas sent through the breathing gas line. The at least one cooling element is separated from the breathing gas with a wall and the wall is a deformable wall, so that a direct contact can be established between the at least one cooling element and the deformable wall by means of a deformation of the deformable wall.

20 Claims, 3 Drawing Sheets

BREATHING CIRCUIT DEVICE

CROSS REFERENCE TO RELATED APPLICATIONS

This application claims the benefit of priority under 35 U.S.C. § 119 of European Patent Application EP 10 159 309.3 filed Apr. 8, 2010, the entire contents of which are incorporated herein by reference.

FIELD OF THE INVENTION

The present invention pertains to a breathing circuit device comprising a breathing gas line for forming a closed breathing system, a cooling device with at least one cooling element for cooling a breathing gas sent through the breathing gas line, wherein the at least one cooling element is separated by a wall from the breathing gas.

BACKGROUND OF THE INVENTION

Breathing circuit devices can make breathing air or breathing gas available to a respirator user of the breathing circuit device over a longer period of time. The carbon dioxide is removed from the expiration gas expired by the respirator user by means of a carbon dioxide absorber and oxygen is fed in from an oxygen tank. Breathing gas can thus be made available for the respirator user from a small and compact breathing circuit device with a small volume of pure oxygen in the oxygen tank even for a longer period of time, e.g., four hours.

Breathing lime or alkali, which absorbs the carbon dioxide present in the expiration gas expired by the respirator user, is contained in the carbon dioxide absorber. Moisture and heat are released during this chemical reaction, and this leads to a corresponding heating and humidification of the inspiration gas because the expiration gas expired by the respirator user is again made available as an inspiration gas to the respirator user in a breathing circuit system. This is unacceptable for a physiologically tolerable breathing climate, so that cooling and dehumidification of the expiration gas is necessary after passage through the carbon dioxide absorber. The breathing circuit device is provided for this purpose with a cooling element for cooling and hence also dehumidifying the breathing gas. The expiration gas is cooled by means of the cooling element and cooled to below the dew point in the process, so that the moisture contained in the breathing gas condenses. Various means, for example, water ice, a latent heat storage means or a zeolite cooler, are used as cooling elements.

A cooling device for breathing gas cooling in a respirator with a heat collector exposed to the breathing gas flow is known from DE 40 29 084 A1. The heat collector is designed as a reservoir for an evaporable liquid and can be connected to an evacuable absorbent container, so that the liquid evaporates while absorbing heat of evaporation and its vapor is absorbed on an absorbent present in the absorbent container while heat of absorption and heat of condensation are released, the absorbent container being designed as a cooling body arranged outside the breathing gas flow and intended for releasing heat to the environment.

It is not possible to arrange different cooling elements at the breathing circuit device in the breathing circuit devices known from the state of the art if good heat conduction from the breathing gas to the cooling element is to be guaranteed at the same time. Different cooling elements have different surfaces, so that adaptation to these different surfaces is necessary for good heat conduction from the breathing gas to the cooling element.

SUMMARY OF THE INVENTION

The object of the present invention is therefore to make available a breathing circuit device, in which different cooling elements can be used in a simple and reliable manner with good heat conduction from the breathing gas to the cooling element.

This object is accomplished with a breathing circuit device, comprising at least one breathing gas line to form a closed breathing system, a carbon dioxide absorber for extracting carbon dioxide from the breathing gas sent through the closed breathing system, preferably a cooling device with a cooling element for cooling the breathing gas sent through the closed breathing system, wherein the cooling element is separated with a wall from the breathing gas in the at least one breathing gas line, an oxygen tank for storing oxygen, an oxygen feeding unit for introducing oxygen from the oxygen tank into the breathing gas, wherein the wall is a deformable wall, so that by means of deforming the deformable wall, direct contact can be established between the cooling element and the deformable wall for adaptation to different cooling elements. The deformable wall can be adapted to the different surface structure of the cooling element, so that there is a direct, large-surface contact between the deformable wall and the cooling element even when different cooling elements are used in the breathing circuit device and good heat conduction is thus guaranteed from the breathing gas to be cooled and dehumidified and the cooling element. Different cooling elements, for example, ones with water ice, a latent heat storage means or an evaporator, a zeolite cooler, can thus be advantageously used in the breathing circuit device. The breathing circuit device can thus be used with different cooling devices or cooling elements in a flexible manner for different fields of application.

In particular, a pressure on a first side of the wall with the cooling element is lower than on a second side, so that the deformable wall is pressed onto the cooling element because of the pressure difference between the first and second sides of the deformable wall. The pressure on the first side of the wall corresponds to a breathing gas pressure, and the pressure on the second side of the wall corresponds to an ambient pressure. Based on the pressure difference and the higher pressure on the first side of the deformable wall, the deformable wall is thus pressed by the breathing gas pressure onto the surface of the cooling element, so that there is a direct, large-surface contact between the deformable wall and the cooling element because of the deformability of the deformable wall. The heat can thus be transmitted to a sufficient extent from the breathing gas to the deformable wall and subsequently from the deformable wall to the cooling element for cooling and dehumidifying the breathing gas at the deformable wall.

In another embodiment, the cooling element lies directly on the deformable wall. Because of the direct contact between the cooling element and the deformable wall, good heat conduction is thus possible from the deformable wall to the cooling element.

In an additional embodiment, the breathing gas is directly in contact with the second side of the deformable wall.

Heat insulation is preferably arranged at the cooling element on the outside and/or the breathing gas is indirectly or directly in contact or in thermal contact with the deformable wall. The heat insulation prevents the cold made available by the cooling element from escaping into the environment of the breathing circuit device to a greater extent, so that the cold made available by the cooling element is used essentially to cool and dehumidify the breathing gas in the breathing circuit device with the at least one breathing gas line. In case of a direct contact or direct thermal connection between the breathing gas and the deformable wall, the breathing gas is sent directly to the deformable wall. In case of an indirect contact or indirect thermal connection between the breathing gas and the deformable wall, an additional device is arranged between the breathing gas and deformable wall, so that the heat is sent from the breathing gas to the device and subsequently to the deformable wall. This device may be, for example, another wall or a container containing a liquid or a gel.

In one variant, the breathing circuit device has a breathing bag as part of the at least one breathing gas line and/or the deformable wall forms an outer wall of the breathing circuit device, especially of a housing of the breathing circuit device.

The cooling element is preferably arranged at least partly and especially entirely within the breathing bag, and the deformable wall separates the cooling element from the breathing gas in the breathing bag.

In another embodiment, part of the wall of the breathing bag forms the deformable wall, on which the cooling element directly lies.

In particular, a liquid or gel is enclosed in a container with walls and at least one wall of the container is formed by the deformable wall and the cooling element lies on the deformable wall of the container.

In another embodiment, a hot side of the container is in thermal contact with the breathing gas, and the cooling element is in contact with the deformable wall of the container as a cold side of the container. The heat of the breathing gas is thus sent indirectly through the container containing the gel to the deformable wall. The cooling element lies on the deformable wall on the cold side. The liquid or gel in the container can be deformed during a phase change, e.g., from a solid into a liquid state, and thus it also permits deformation of the deformable wall for adaptation to different surface structures of the cooling element.

In an additional variant, the deformable wall is a film and/or a two-dimensional, flexible surface part and/or a fabric.

In another variant, the cooling element is a cooling container containing water ice or a latent heat storage means or a liquid of a sorption cooler, especially zeolite cooler, which said liquid is to be evaporated.

In an additional embodiment, the deformable wall consists at least partly and preferably entirely of a plastic.

The breathing circuit device preferably comprises an inspiration line and an expiration line.

In another variant, the breathing circuit device has a Y-piece.

In an additional variant, the inspiration and expiration lines are connected to the Y-piece.

A nonreturn valve each is preferably arranged at the inspiration line and the expiration line.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
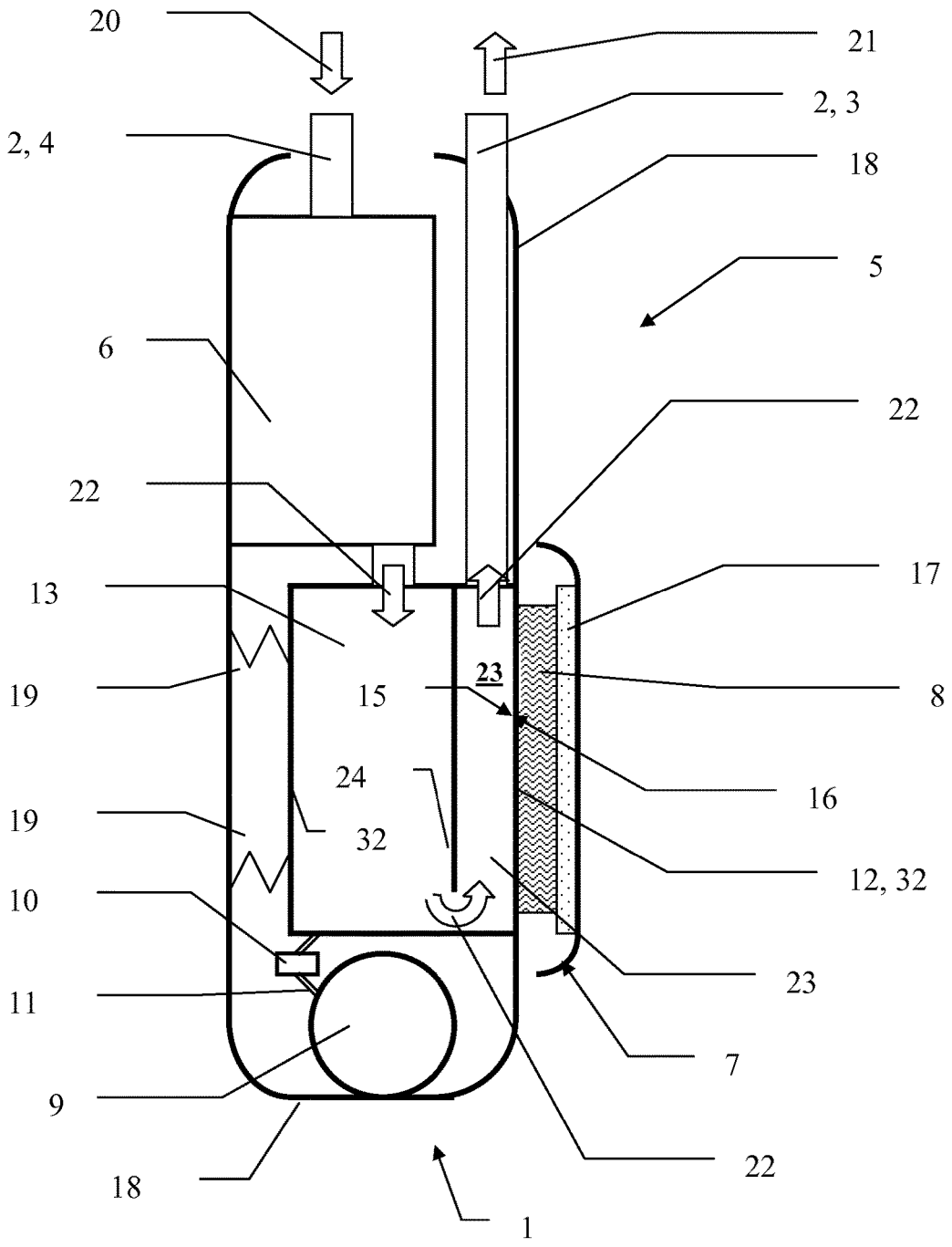
FIG. 1 is a simplified view of a breathing circuit device according to a first embodiment of the invention.

Referring to the drawings in particular, a breathing circuit device 1 shown in FIG. 1 makes available breathing gas or breathing air for a respirator user, not shown, of the breathing circuit device 1. The breathing circuit device 1 has a housing 18 made of plastic and/or metal. Breathing gas lines 2 are arranged as inspiration line 3 and as expiration line 4 within the housing 18. The expiration gas 20 expired by the respirator user flows through the expiration line 4 into the breathing circuit device 1 and the inspiration gas 21 flows out of the breathing circuit device 1 through the inspiration line 3 and is inspired by the respirator user. The breathing gas lines 2 form a preferably completely closed breathing system 5, so that no air is introduced into the breathing gas lines 2 from the environment of the breathing circuit device 1. The expiration gas 20 is sent to a carbon dioxide absorber 6 after it flows into the expiration line 4 according to the top part of FIG. 1. The carbon dioxide absorber 6 is designed as a breathing lime container, which contains breathing lime. Carbon dioxide is thus extracted from the expiration gas 20 in the breathing lime container containing breathing lime. The temperature of the breathing lime in the breathing lime container rises during this chemical reaction and the breathing lime also releases part of the heat to the expiration gas 20. The breathing gas 22 flowing out of the carbon dioxide absorber 6 is subsequently fed to a breathing bag 13. This breathing gas 22 fed to the breathing bag 13 is essentially freed from carbon dioxide and has a temperature, for example, in the range of 55° C. The expiration gas was thus heated from 30° C. after expiration at the respirator user to a temperature of 55° C. and has a relative humidity in the range of 100%.

An oxygen tank 9 arranged within the housing 18, an oxygen feeding unit 10, designed, for example, as a valve, and an oxygen line 11 are used to feed oxygen from the oxygen tank 9 to the breathing gas in the breathing bag 13. The expiration gas 20 is thus replaced with oxygen, i.e., the oxygen content in the expiration gas 20 is increased, so that this can again be fed to the respirator user of the breathing circuit device 1 with a sufficient oxygen content.

The breathing bag 13 has deformable breathing bag walls 32. A partition 24 is formed within the breathing bag 13, so that a channel 23 is formed within the breathing bag 13. Part of the breathing bag wall 32 forms an outer wall of the breathing circuit device 1 or a part of the wall of housing 18. A cooling element 8 as a part of a cooling device 7 lies on this part of the breathing bag wall 32, which part forms the housing 18. The cooling element 8 is a container filled with water ice. In addition, heat insulation 17 is attached to the cooling element 8 on the outside. Two springs 19, which are connected to both the breathing bag wall 32 and the housing 18, are arranged at the breathing bag wall 32. Springs 19 apply a weak pressing force on the breathing bag wall 32, so that the pressure of the breathing gas within the breathing bag 13 is slightly higher than the ambient pressure outside the breathing circuit device 1. Thus, a lower pressure is present outside the breathing bag 13 than within the breathing bag 13. The breathing gas 22 introduced into the breathing bag 13 flows through the channel 23 and then it flows again out of the breathing bag 13 into the inspiration line 3 after flowing through channel 23. The part of the breathing bag wall 32 on which the cooling element 8 lies forms a deformable wall 12. The deformable wall 12 has a first side 15, which is in direct contact with breathing gas 22. The deformable wall 12 has, furthermore, a second side 16, with which the cooling element 8 is in contact. The above-described pressure difference between the breathing gas 22 within the breathing bag 13 and the ambient pressure outside the breathing bag 13 causes the deformable wall 12 to be pressed onto the cooling element 8. The cooling element 8 is detachably connected to the breathing circuit device 1, especially the housing 18 of the breathing circuit device 1, by means of at least one fastening device, not shown. This at least one fastening device is designed such that different cooling elements 8 can also be attached to the breathing circuit device 1.

A deformable wall 12 designed as a film thus makes it possible because of the existing pressure difference that a cooling element 8 with a different surface structure can be attached to the breathing circuit device 1 and there is a direct, large-surface contact area between the deformable wall 12 and the surface of the cooling element 8 based on the deformability of the wall 12 and on the existing pressure difference. As a result, the heat can be sent sufficiently well from the breathing gas 22 through the deformable wall 12 and to the cooling element 8 even when different cooling elements 8 with different surface structures are used. The breathing gas 22 within the breathing bag 13 is thus cooled at the deformable wall 12 and, in addition, the moisture condenses here. The humidity in the inspiration gas 21, which flows out of the breathing bag 13, can thus be reduced to physiologically tolerable values.

The contact area between the deformable wall 12 and the cooling element 8 is in the range of about 600 $cm^2$. This contact area is preferably larger than 300 $cm^2$, 400 $cm^2$, 600 $cm^2$ or 800 $cm^2$, so that sufficiently good heat transfer from the breathing gas 22 to the cooling element 8 is guaranteed even when different cooling elements 8 are used.

Figure 2:
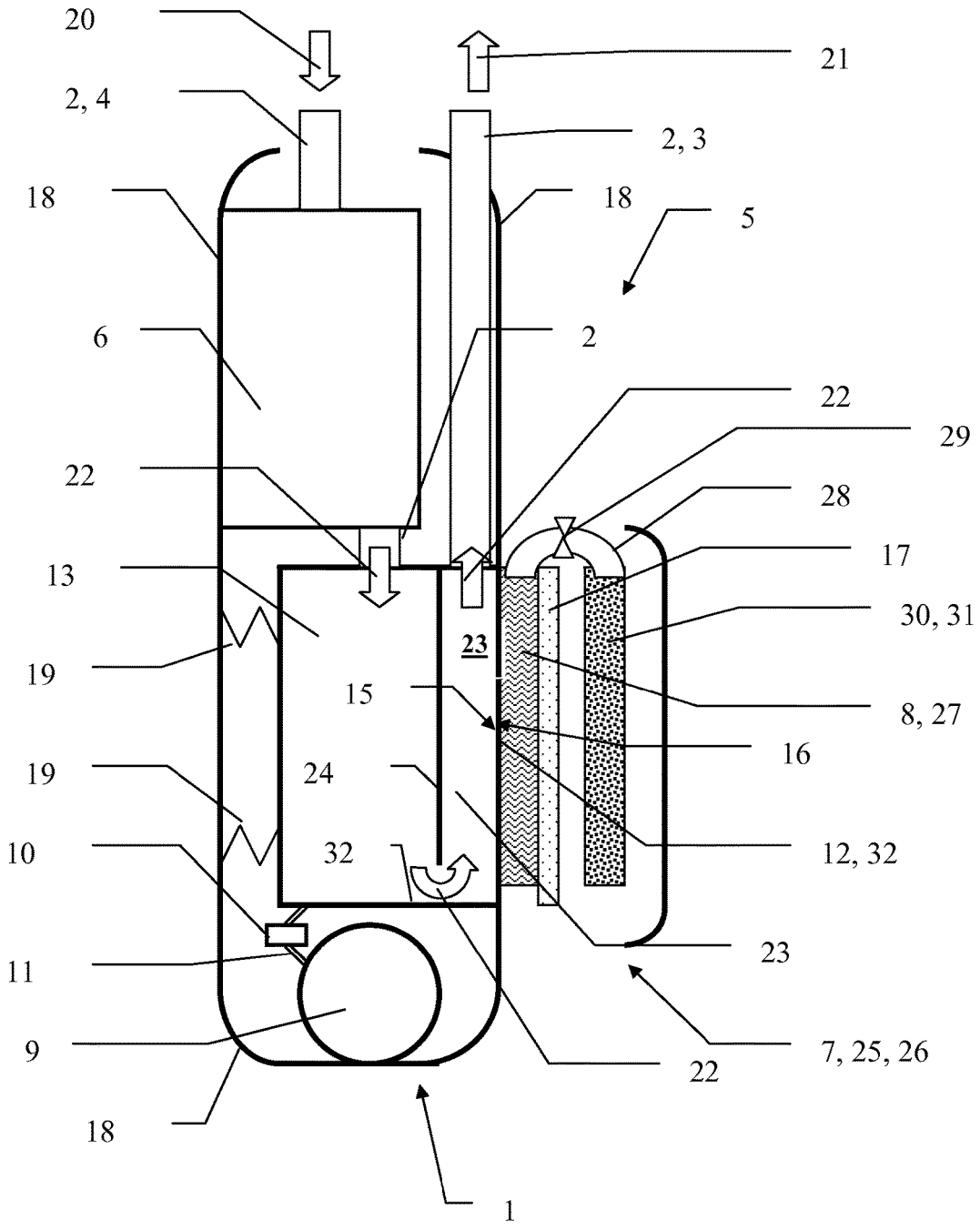
FIG. 2 is a simplified view of the breathing circuit device according to a second embodiment of the invention.

FIG. 2 shows a second exemplary embodiment of the breathing circuit device 1. Essentially only the differences from the first exemplary embodiment according to FIG. 1 are described below. The cooling device 1 is a sorption cooler 25 designed as a zeolite cooler 26. An evaporator 27 is used as a cooling element 8. The evaporator 27 is a container containing an evaporable liquid, especially water. The evaporator 27 is connected by a vapor line 28 having a valve 29 to a sorbent container 30 designed as a zeolite container 31. Zeolite is arranged within a container in the zeolite container 31. When valve 29 is opened, the liquid in the evaporator 27 evaporates and the evaporator 27 cools as a result and can thus cool and dehumidify the breathing gas 22 in channel 23 through the deformable wall 12. The vapor formed in the evaporator 27 is sent through the vapor line 28 to the zeolite in the zeolite container 31 and is adsorbed there. Heat, which is released to the environment, is thus formed in the zeolite within the zeolite container 31. The heat insulation 17 at the evaporator 27 as a cooling element 8 prevents the heat made available by the evaporator 27 from being drawn off to a greater extent to the environment of the breathing circuit device 1 and it can thus be used essentially to cool and dehumidify the breathing gas 22 in the channel 23.

Figure 3:
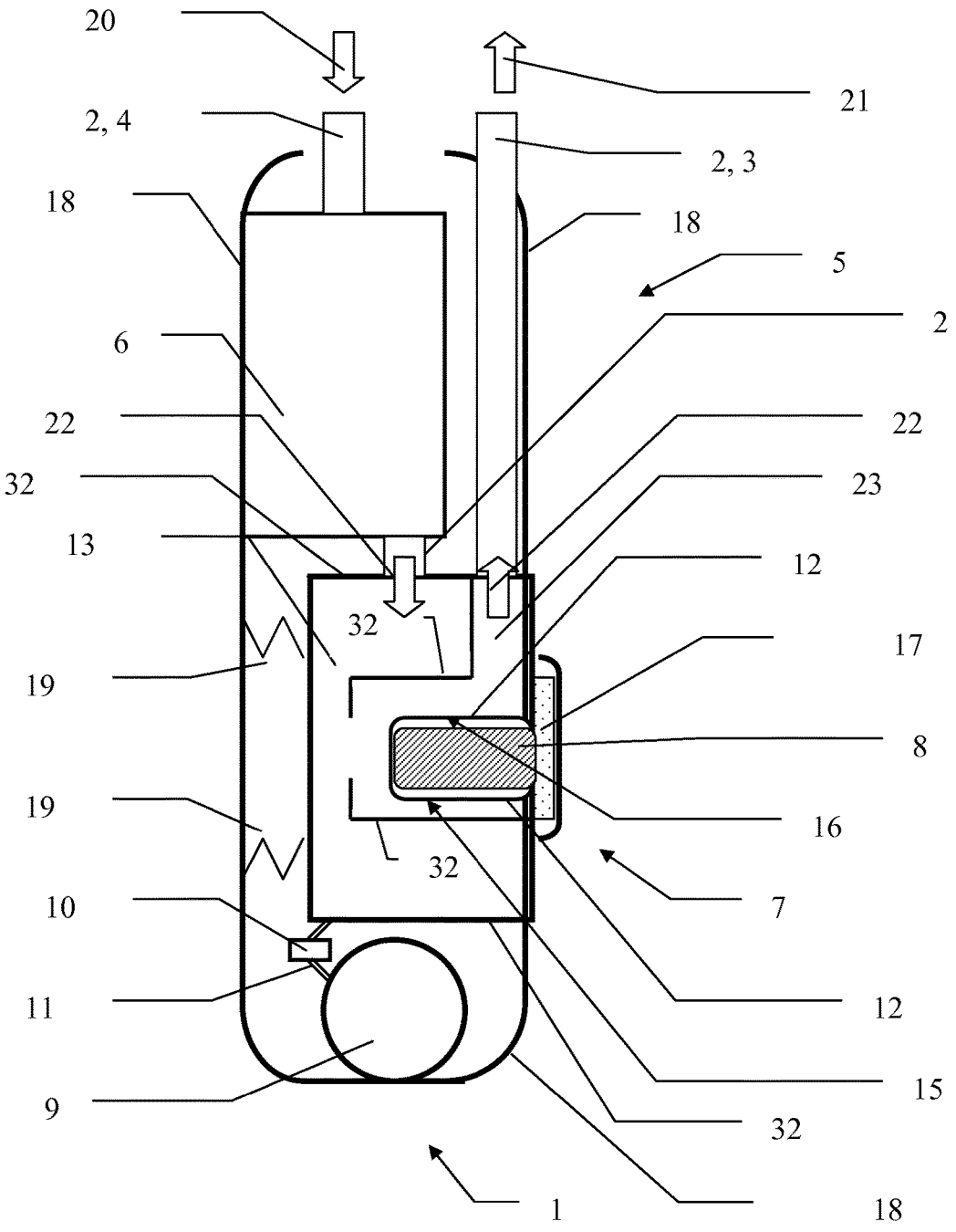
FIG. 3 is a simplified view of the breathing circuit device according to a third embodiment of the invention.

FIG. 3 shows a third exemplary embodiment of the breathing circuit device 1. Essentially only the differences from the first exemplary embodiment according to FIG. 1 will be described below. The replaceable cooling element 8 is arranged within the breathing bag 13. The cooling element 8 is separated from the breathing gas 22 within the breathing bag 13 by means of the deformable wall 12 as a film. Based on the pressure difference between the breathing gas within the breathing bag 13 and the environment of the breathing bag 13, which also includes the space within the deformable wall 12 with the cooling element 8, the deformable wall 12 is pressed onto the cooling element 8. Only a small part of the surface of the cooling element 8 is arranged on the outside in the area of the housing 18, so that only a small surface of the cooling element 8 needs to be thermally insulated from the environment by the heat insulation 17. The cold made available by the cooling element 8 can be made available essentially completely for cooling and dehumidifying the breathing gas 22 within the breathing bag 13.

For example, a latent heat storage means with paraffin, salt hydrate, or a cooling element 8 as part of a Peltier cooler or of a heat pump or refrigerating unit may be used as a cooling element 8, the cooling element 8 representing the evaporator of a refrigerating circuit with a compressor and a condenser in case of the heat pump or refrigerating unit.

On the whole, essential advantages are associated with the breathing circuit device 1 according to the present invention. Cooling elements 8 with a different surface structure can be arranged at the breathing circuit device 1, so that different cooling elements 8 can be used with a basic breathing circuit device 1 in a flexible manner for different fields of application of the breathing circuit device 1. A breathing circuit device 1 with different cooling elements 8 can be made available for a great variety of applications with a basic breathing circuit device 1, which can be manufactured in a cost-effective manner.

While specific embodiments of the invention have been shown and described in detail to illustrate the application of the principles of the invention, it will be understood that the invention may be embodied otherwise without departing from such principles.

APPENDIX

LIST OF REFERENCE NUMBERS

| | | | |
|---|---|---|---|
| 1 | Breathing circuit device | 20 | Expiration gas |
| 2 | Breathing gas line | 21 | Inspiration gas |
| 3 | Inspiration line | 22 | Breathing gas |
| 4 | Expiration line | 23 | Channel in breathing bag |
| 5 | Closed breathing system | 24 | Partition in breathing bag |
| 6 | Carbon dioxide absorber | 25 | Sorption cooler |
| 7 | Cooling device | 26 | Zeolite cooler |
| 8 | Cooling element | 27 | Evaporator |
| 9 | Oxygen tank | 28 | Vapor line |
| 10 | Oxygen feeding unit | 29 | Valve |
| 11 | Oxygen line | 30 | Sorbent container |
| 12 | Deformable wall | 31 | Zeolite container |
| 13 | Breathing bag | 32 | Breathing bag wall |
| 15 | First side of wall with cooling element | | |
| 16 | Second side of wall with breathing gas | | |
| 17 | Heat insulation | | |
| 18 | Housing of breathing circuit device | | |
| 19 | Spring | | |

What is claimed is:

1. A breathing circuit device, comprising:

a breathing gas line forming a closed breathing system, wherein a breathing bag is part of the breathing gas line, said breathing bag comprising a breathing bag interior and a partition wall, said partition wall extending within said breathing bag interior;

a cooling device with at least one cooling element for cooling a breathing gas sent through the breathing gas line; and a deformable wall separating the at least one cooling element from the breathing gas, the deformable wall establishing a direct contact between the at least one cooling element and the deformable wall by a deformation of the deformable wall, said deformable wall and said partition wall defining a channel, said breathing gas exiting said breathing bag via said channel, said at least one cooling element engaging said deformable wall in an area adjacent to said channel.

2. A breathing circuit device in accordance with claim 1, further comprising:

a spring, wherein said spring applies a force to said breathing bag such that a pressure on a first side of the deformable wall with the cooling element is higher than a pressure on a second side of the deformable wall, so that the deformable wall is pressed onto the cooling element based on a pressure difference between the first side and the second side.

3. A breathing circuit device in accordance with claim 1, wherein the cooling element lies directly on the area of said deformable wall adjacent to said channel.

4. A breathing circuit device in accordance with claim 2, wherein the breathing gas is directly in contact with the first side of the deformable wall.

5. A breathing circuit device in accordance with claim 1, further comprising heat insulation arranged at the cooling element on an outside.

6. A breathing circuit device in accordance with claim 1, wherein the cooling element is arranged at least partly within the breathing bag and the deformable wall separates the cooling element from the breathing gas in the breathing bag.

7. A breathing circuit device in accordance with claim 1, wherein a part of a breathing bag wall of the breathing bag forms the deformable wall, on which the cooling element directly lies.

8. A breathing circuit device in accordance with claim 1, further comprising:

a container; and a liquid or gel, wherein the liquid or gel is enclosed in the container with walls of the container and at least one of said walls of the container is formed by the deformable wall and the cooling element lies on the deformable wall of the container.

9. A breathing circuit device in accordance with claim 8, wherein a hot side of the container is in thermal contact with the breathing gas and the cooling element lies on the deformable wall of the container as a cold side of the container.

10. A breathing circuit device in accordance with claim 1, wherein the deformable wall is a film and/or a two-dimensional flexible surface part and/or a fabric.

11. A breathing circuit device in accordance with claim 1, wherein the cooling element is a cooling container containing water ice or a latent heat storage means or a liquid of a sorption cooler or a zeolite cooler, which said liquid is to be evaporated.

12. A breathing circuit device in accordance with claim 1, further comprising a carbon dioxide absorber for removing carbon dioxide from the breathing gas sent through the closed breathing system.

13. A breathing circuit device in accordance with claim 1, further comprising an oxygen tank for storing oxygen and an oxygen feeding unit for introducing oxygen from the oxygen tank into the breathing gas line.

14. A breathing circuit device in accordance with claim 1, wherein the breathing gas is indirectly or directly in thermal connection with the deformable wall.

15. A breathing circuit device in accordance with claim 2, further comprising:

a housing wherein the deformable wall forms an outer wall of the housing, said spring being in direct contact with said housing and said breathing bag.

16. A breathing circuit device, comprising:

a breathing gas line forming a breathing system, said breathing system comprising a breathing bag, said breathing bag comprising a breathing gas inlet, a breathing gas outlet and a partition wall extending in an interior thereof;

a carbon dioxide absorber connected to the breathing system;

a cooling element for cooling a breathing gas sent through the breathing gas line;

a deformable wall separating the at least one cooling element from the breathing gas;

a breathing circuit device housing, said deformable wall and said partition wall defining a breathing gas channel, said breathing gas channel being in communication with said breathing gas inlet and said breathing gas outlet, said breathing gas entering said breathing bag via said breathing gas inlet and said breathing gas exiting said breathing bag via said breathing gas channel and said breathing gas outlet, said cooling element being arranged in direct contact with said deformable wall in an area of said deformable wall adjacent to said breathing gas channel; and a pressure means for establishing a pressure on a side of the deformable wall opposite to the cooling element that is higher than a pressure on a side of the deformable wall with the cooling element such that the deformable wall establishes direct contact with the cooling element by a deformation of the deformable wall.

17. A breathing circuit device in accordance with claim 16, wherein the breathing gas is directly in contact with the first side of the deformable wall.

18. A breathing circuit device in accordance with claim 16, further comprising heat insulation arranged at the cooling element on an outside.

19. A breathing circuit device in accordance with claim 16, wherein the deformable wall forms at least a portion of the breathing bag.

20. A breathing circuit device, comprising:

a breathing gas line forming a closed breathing system, said closed breathing system comprising a breathing bag, said breathing bag comprising a deformable wall, a breathing gas inlet, a breathing gas outlet and a partition wall extending in an interior of said breathing bag, said deformable wall forming at least a portion of said breathing bag, said breathing gas outlet being located at a spaced location from said breathing gas inlet, said breathing bag being in communication with said breathing gas line, said partition wall and another portion of said breathing bag forming a first fluid flow path portion, said deformable wall and said partition wall defining a second fluid flow path portion, said breathing gas inlet being in communication with said first fluid flow path portion, said second fluid flow path portion and said breathing gas outlet to define a breathing bag fluid flow path;

a housing, said breathing bag being arranged in said housing; and a cooling device with at least one cooling element for cooling a breathing gas sent through the breathing gas line, said deformable wall separating the at least one cooling element from the breathing gas, the deformable wall establishing a direct contact between the at least one cooling element and the deformable wall by a deformation of the deformable wall, said breathing gas passing through said first fluid flow path portion in a first fluid flow direction, said breathing gas passing through said second fluid flow path portion in a second fluid flow direction, said first fluid flow direction being opposite said second fluid flow direction, said breathing gas exiting said breathing bag via at least said breathing gas outlet, said at least one cooling element engaging an area of said deformable wall adjacent to said second fluid flow path portion.

* * * * *